US010113456B2

(12) United States Patent
Lee et al.

(10) Patent No.: US 10,113,456 B2
(45) Date of Patent: Oct. 30, 2018

(54) ENGINE OIL SUPPLY SYSTEM

(71) Applicants: Hyundai Motor Company, Seoul (KR); Kia Motors Corporation, Seoul (KR)

(72) Inventors: Kam Chun Lee, Geoje-si (KR); Joong Hyun Hwang, Suwon-si (KR); Byung Chul Lee, Suwon-si (KR); Jong Beom Seo, Suwon-si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 234 days.

(21) Appl. No.: 15/162,358

(22) Filed: May 23, 2016

(65) Prior Publication Data

US 2017/0167330 A1 Jun. 15, 2017

(30) Foreign Application Priority Data

Dec. 9, 2015 (KR) ..... 10-2015-0175436

(51) Int. Cl.

| | |
|---|---|
| ***F01M 5/00*** | (2006.01) |
| ***F01M 11/02*** | (2006.01) |
| ***F01M 11/00*** | (2006.01) |
| ***F01M 1/02*** | (2006.01) |
| ***F01M 1/10*** | (2006.01) |

(52) U.S. Cl.

CPC ..... *F01M 5/007* (2013.01); *F01M 1/02* (2013.01); *F01M 1/10* (2013.01); *F01M 5/002* (2013.01); *F01M 11/0004* (2013.01); *F01M 11/02* (2013.01); *F01M 2001/1092* (2013.01); *F01M 2011/0025* (2013.01); *F01M 2011/0029* (2013.01); *F01M 2011/0066* (2013.01)

(58) Field of Classification Search

CPC .... F01M 5/007; F01M 11/02; F01M 11/0004; F01M 1/10; F01M 1/02; F01M 5/002; F01M 2001/1092; F01M 2011/0025; F01M 2011/0029; F01M 2011/0066

See application file for complete search history.

(56) References Cited

U.S. PATENT DOCUMENTS

| | | | | |
|---|---|---|---|---|
| 4,426,965 A * | 1/1984 | Patel | F01M 5/002 | 123/196 AB |
| 6,058,898 A * | 5/2000 | Freese, V | F01M 11/0004 | 123/195 C |
| 2015/0159774 A1* | 6/2015 | Kim | F01M 5/007 | 236/94 |

(Continued)

FOREIGN PATENT DOCUMENTS

| | | |
|---|---|---|
| JP | 2006-78169 A | 3/2006 |
| JP | 2007-77925 A | 3/2007 |

(Continued)

*Primary Examiner* — Michael R Mansen
*Assistant Examiner* — Robert T Reese
(74) *Attorney, Agent, or Firm* — Morgan, Lewis & Bockius LLP

(57) ABSTRACT

An engine oil supply system may include an oil pan connected with an oil pump at a first side and connected with an oil cooler at a second side, an oil passage through which oil pressurized by the oil pump flows, an oil filter disposed in the oil pan to filter impurities in the oil supplied from the oil pump, and a bypass valve disposed in the oil passage to selectively supply the oil in the oil passage to at least one of the oil cooler and the oil filter.

13 Claims, 5 Drawing Sheets

(56) References Cited

U.S. PATENT DOCUMENTS

2015/0330273 A1* 11/2015 Chung ..... F01M 5/002
701/34.4

FOREIGN PATENT DOCUMENTS

| | | | |
|---|---|---|---|
| KR | 10-1984-0003731 | A | 9/1984 |
| KR | 10-2000-0047595 | A | 7/2000 |
| KR | 10-2005-0038168 | A | 4/2005 |
| KR | 10-1501147 | B1 | 3/2015 |

* cited by examiner

ENGINE OIL SUPPLY SYSTEM

CROSS REFERENCE TO RELATED APPLICATION

The present application claims priority to Korean Patent Application No. 10-2015-0175436, filed Dec. 9, 2015, the entire contents of which is incorporated herein for all purposes by this reference.

BACKGROUND OF THE INVENTION

Field of the Invention

The present invention relates to an engine oil supply system for a vehicle and, more particularly, to an engine oil supply system including an oil pump, an oil cooler, an oil filter, and an oil pan to supply engine oil to the main gallery and bearings of a cylinder block of an engine.

Description of Related Art

In general, engine oil for lubricating parts of an engine is supplied to the engine. The oil is kept in an oil pan under the engine and supplied to the main gallery and bearings of the engine through a connecting rod and a piston by an oil pump connected by a belt, when the engine is operated.

However, if the oil always flows through an oil cooler regardless of the temperature of the oil, the oil is excessively cooled when the engine is started at low temperature in winter or a vehicle is driven at a low speed at a low temperature, so a loss of friction increases and it takes long time to increase the temperature of the oil to an appropriate level.

Accordingly, a method of supplying oil through a bypass path to prevent the oil from flowing through an oil cooler has been used, but this method just decreases the time for increasing the oil temperature to an appropriate level when an engine is started at a low temperature by allowing only a predetermined amount of oil to bypass the oil cooler regardless of the temperature of the engine, so it is difficult to adjust the oil temperature to appropriate levels in accordance with changing driving conditions.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine oil supply system that allows oil to bypass an oil cooler in accordance with the temperature of the oil, has a simple configuration, and improves fuel efficiency.

According to various aspects of the present invention, an engine oil supply system may include an oil pan connected with an oil pump at a first side and connected with an oil cooler at a second side, an oil passage through which oil pressurized by the oil pump flows, an oil filter disposed in the oil pan to filter impurities in the oil supplied from the oil pump, and a bypass valve disposed in the oil passage to selectively supply the oil in the oil passage to at least one of the oil cooler and the oil filter.

The oil passage, the bypass valve, and the oil filter may be integrated in a module in the oil pan.

In the oil pan, the oil passage, the oil filter, and the oil pump may be disposed adjacent a side from a longitudinal center line of the oil pan to provide a space for keeping oil in the oil pan.

The oil cooler may be a separate part and disposed between the oil pan and an engine.

An oil channel may be formed in the oil cooler to supply the oil passing through the oil cooler to the oil filter.

The oil passage may be formed in a longitudinal direction of the oil pan.

The oil passage may include an intake hole at a first side into which the pressurized oil flows from the oil pump, a first supply hole for supplying oil to the oil cooler and a second supply hole for supplying oil to the oil filter at a second side, and the first supply hole and the second supply hole may be formed at different positions to be alternately opened and closed by the bypass valve.

The oil filter may be integrated with the oil pan in a module, thereby eliminating a need for a housing for the oil filter.

The bypass valve may include a wax portion configured to expand at a reference temperature, a moving member with a neck, and an elastic member.

When oil temperature reaches a reference temperature, wax in the wax portion expands and may press against the moving member and the moving member may press against the elastic member, to move the neck of the moving member and to supply the oil in the oil passage to the oil filter.

The wax portion of the bypass valve may include a plurality of wax members having different reference temperatures, for a plurality of reference temperatures to be set for the oil.

The bypass valve may be a multistage bypass valve having a plurality of reference values.

When a temperature of the oil is less than a first reference value, oil may be supplied to an engine and bearings through the oil pump, the oil passage, the oil cooler, and the oil filter.

When the oil temperature is greater than or equal to a first reference value and less than a second reference value, oil may be supplied to an engine and bearings through the oil pump, the oil passage, and the oil filter.

When the oil temperature is greater than or equal to a second reference value, oil may be supplied to an engine and bearings through the oil pump, the oil passage, the oil cooler, and the oil filter.

The engine oil supply system having the structure described above provides the following effects.

First, oil in an oil pan is supplied upward to an oil passage by an oil pump. Accordingly, it is possible to achieve a layout for a multistage bypass valve using the length of the oil pan, so the layout can be achieved without changing engine layouts of the related art. Further, there is no need for a complicated oil supply circuit for an engine (cylinder block), so the structure is simple, machining is easy, and productivity is improved.

Second, an oil pan, an oil passage, a bypass valve, and an oil filter are integrated in a module. Accordingly, there is no need for an oil filter housing by using the oil pan as an oil filter housing, so the manufacturing cost and weight can be reduced. Further, since the bypass valve is disposed in the oil pan, it is not required to increase the shape of an oil filter housing.

Third, the engine oil supply system is disposed lower than the main gallery of an engine (cylinder block). Accordingly, oil remains in the part related to lubrication even if an engine is stopped, and the movement path of the oil is slim, so it takes short time to obtain initial hydraulic pressure when starting an engine, and accordingly, durability of the engine is increased. Further, since the parts related to lubrication are concentrated close to the oil pan, the length of an oil supply circuit decreases, so pressure drop of oil decreases and fuel efficiency is improved. Further, the structure is simplified, so an oil supply structure that is optimized in terms of weight and manufacturing cost can be achieved.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the inventions) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
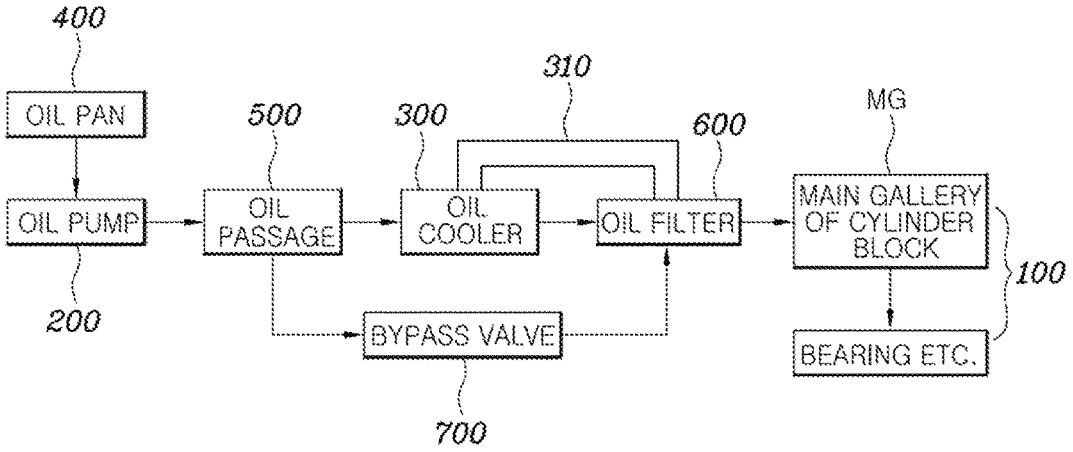
FIG. 1 is a block diagram simply showing the configuration of an exemplary engine oil supply system according to the present invention.
Figure 2:
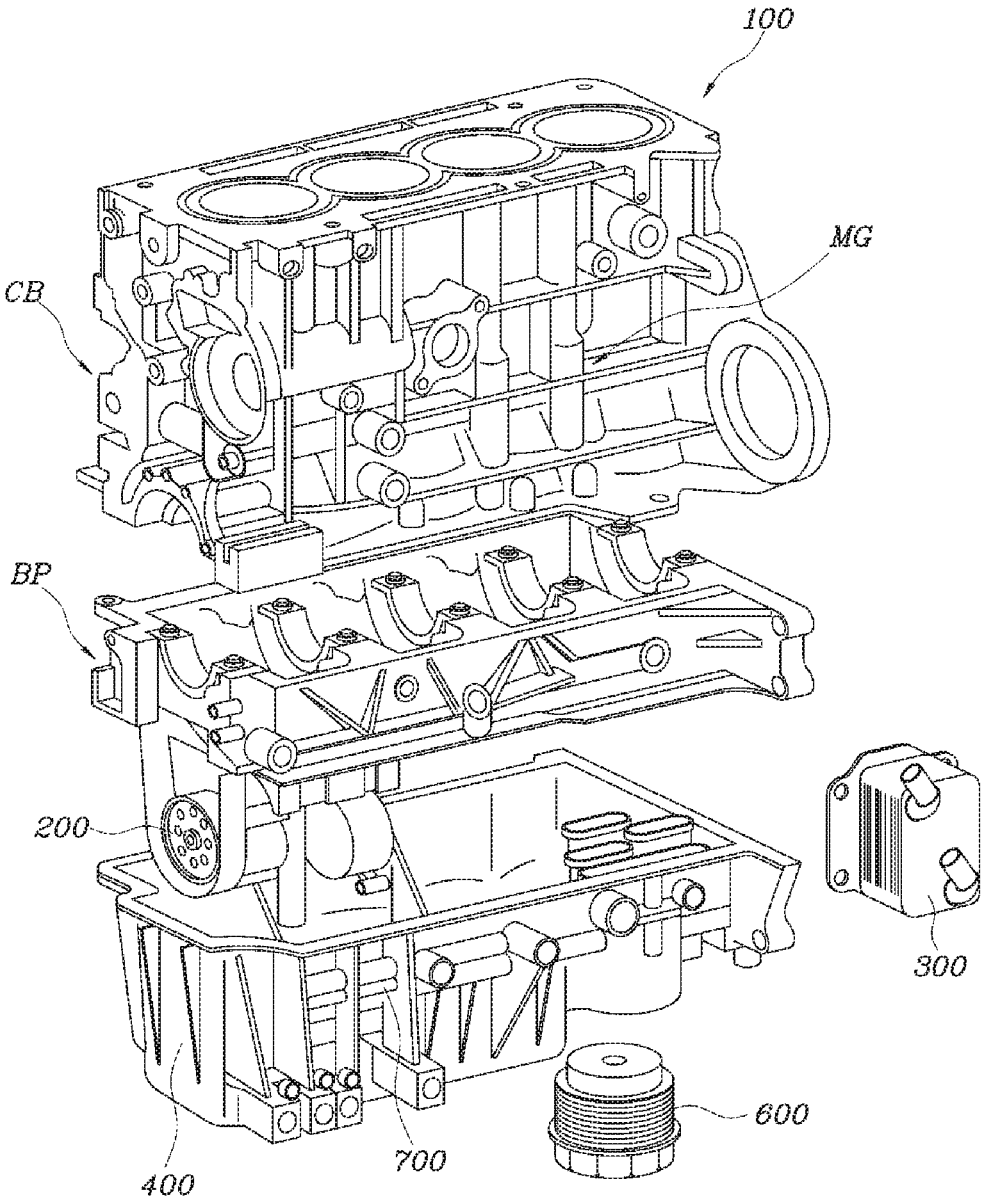
FIG. 2 is an exploded perspective view of the exemplary engine oil supply system according to the present invention.
Figure 3:
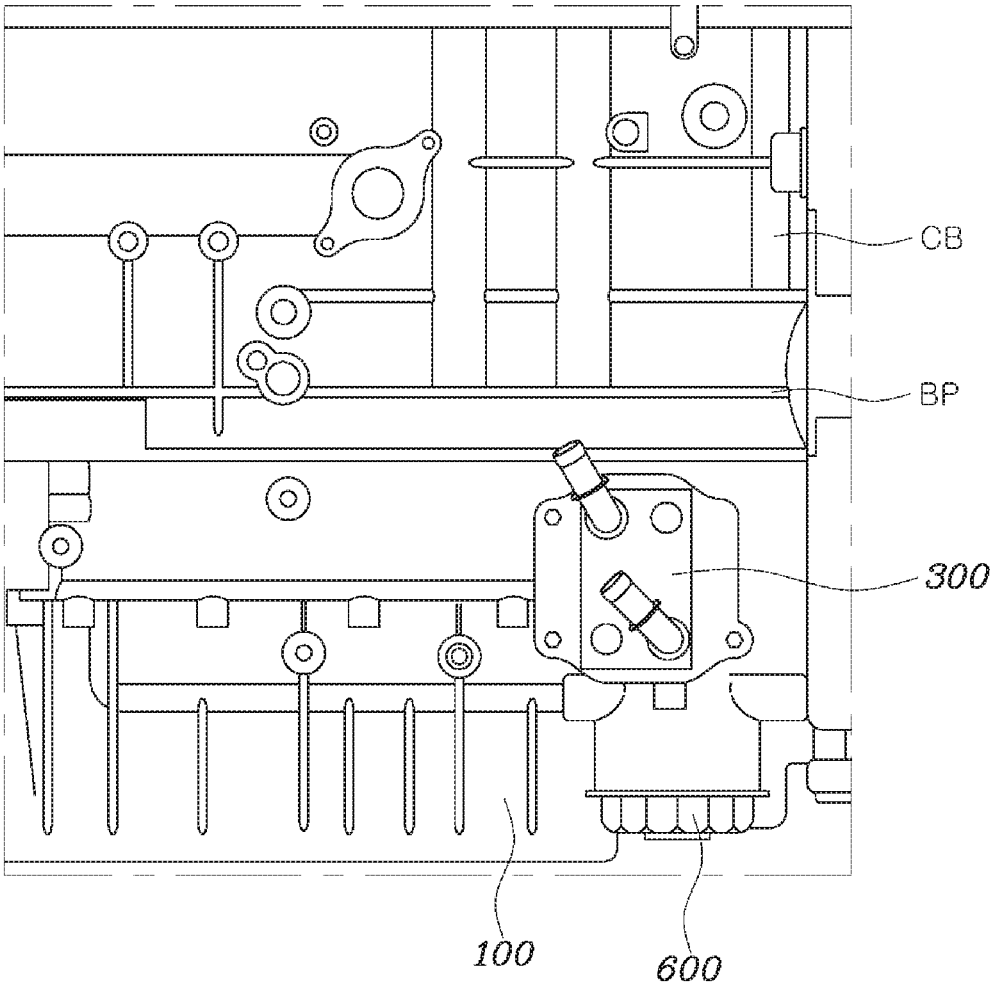
FIG. 3 is a view showing a portion around an oil pan in the assembly of the exemplary system shown in FIG. 2.
Figure 4:
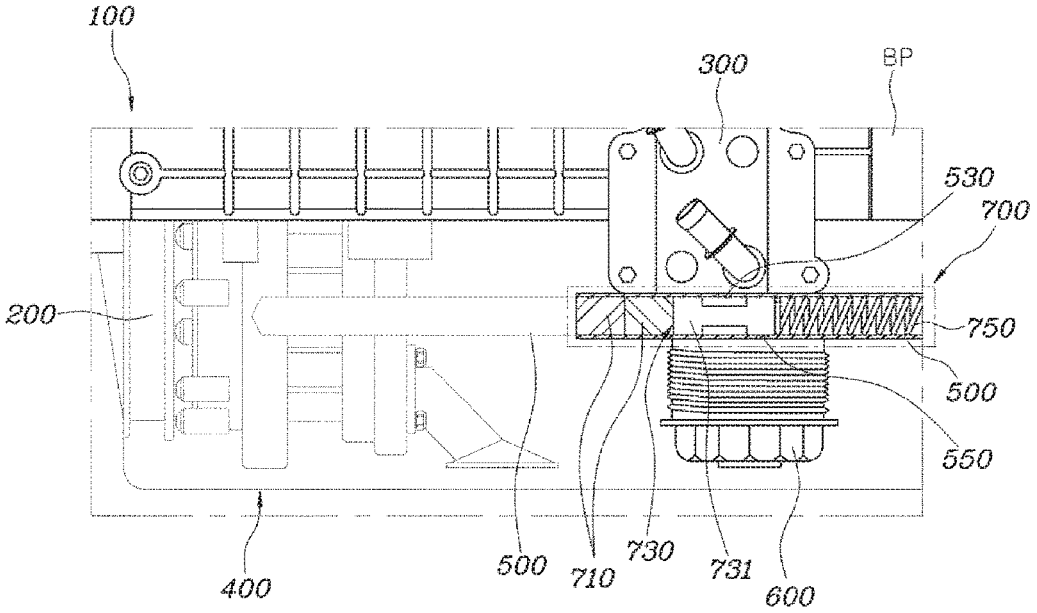
FIG. 4 is a view showing the inside of the portion shown in FIG. 3.
Figure 5:
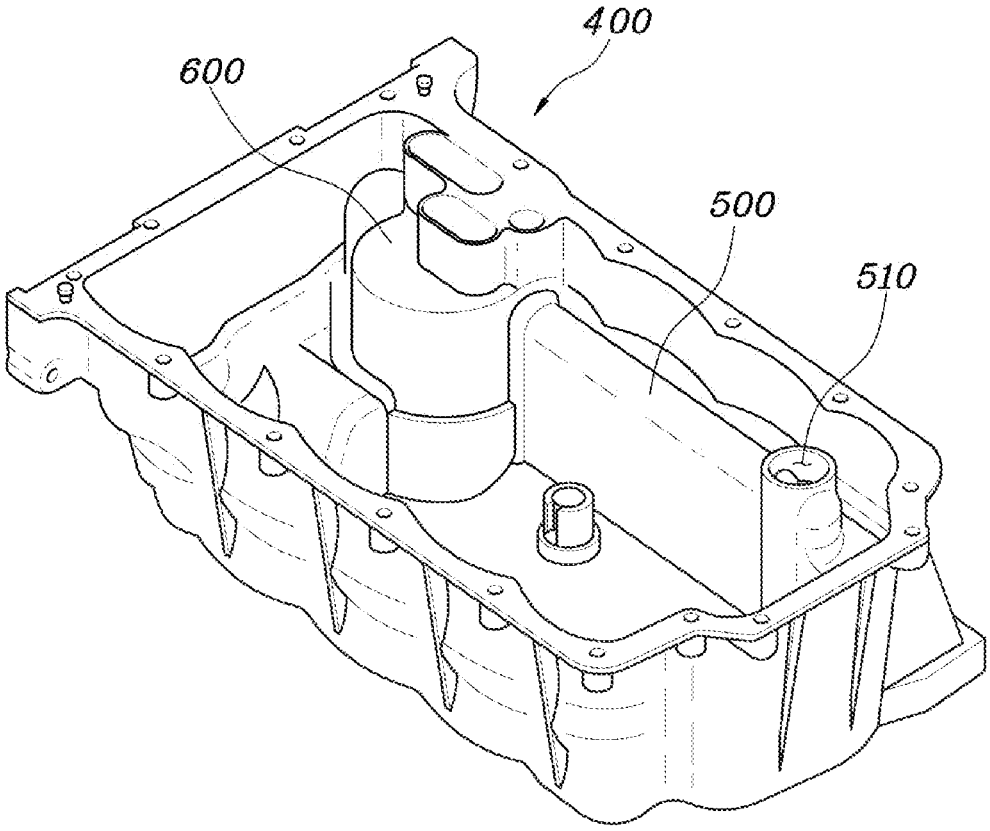
FIG. 5 is a view showing the oil fan.

FIG. 1 is a block diagram simply showing the configuration of an engine oil supply system according to various embodiments of the present invention. FIG. 2 is an exploded perspective view of the engine oil supply system according to various embodiments of the present invention. FIG. 3 is a view showing a portion around an oil pan 400 in the assembly of the system shown in FIG. 2. FIG. 4 is a view showing the inside of the portion shown in FIG. 3, and FIG. 5 is a view showing the oil pan 400.

An engine oil supply system according to various embodiments of the present invention includes an oil pan 400 connected with an oil pump 200 at a first side and connected with an oil cooler 300 at a second side, an oil passage 500 through which oil pressurized by the oil pump 200 flows, an oil filter 600 disposed in the oil pan 400 and filtering impurities in the oil supplied from the oil pump 200, and a bypass valve 700 disposed in the oil passage 500 to selectively supply the oil in the oil passage 500 to the oil cooler 300 or the oil filter 600.

FIG. 1 is a block diagram briefly showing oil supply from the oil pan 400 to the engine 100, in which, unlike the related art, the oil passage 500, the bypass filter 700, and the oil filter 600 are integrated into a module in the oil pan 400. Accordingly, the oil in the oil pan 400 is pressurized by the oil pump 200, sent to the oil cooler 300 or the oil filter 600 through the oil passage 500 at a side of the oil pan 400, and then is supplied to the engine 100, accurately to a main gallery MG of a cylinder block CB. In particular, the oil filter 600 is integrated with the oil pan 400 in a module, so there is no need for a housing for the oil filter 600, unlike an oil filter that is a separate part requiring a housing in the related art.

The oil passage 500 is formed in the longitudinal direction of the oil pan 400, in the oil pan 400, the oil passage 500, the oil filter 600, and the oil pump 200 may be disposed close to a side from the longitudinal center line of the oil pan 400. This is because the oil passage 500, the bypass filter 700, and the oil filter 600 are integrated in a module in the oil pan 400, so a sufficient space for oil in the oil pan 400 can be ensured when they are disposed close to a side.

In particular, the oil cooler 300 is a separate part disposed between the oil pan 400 and the engine 100, in detail, the oil pan 400 and a bed plate BP, so it is possible to increase the temperature of oil using cooling water at a temperature higher than that of oil when the engine 100 is started at a low temperature. An oil channel 310 may be formed in the oil cooler 300 so that the oil passing through the oil cooler 300 is supplied to the oil filter 600.

The oil passage 500 has an intake hole 510 at a first side through which the pressurized oil flows inside from the oil pump 200, and a first supply hole 530 for supplying oil to the oil cooler 300 and a second supply hole 550 for supplying oil to the oil filter 600 at a second side. The first supply hole 530 and the second supply hole 550 are formed at different positions so that they are opened and closed in an alternating manner by the bypass valve 700, that is, when the first supply hole 530 opens, the second supply hole 550 closes, and when the first supply hole 530 closes, the second supply hole 550 opens. Accordingly, the oil supplied into the oil passage 500 through the oil pump 200 is supplied to only one of the oil cooler 300 and the oil filter 600. That is, the path of the oil is changed by the bypass valve 700.

The bypass valve 700 may include of a wax portion 710 that expands at a reference temperature, a moving member 730 that has a neck 731, and an elastic member 750. According to this configuration of the bypass valve 700, when oil temperature reaches a reference temperature, wax in the wax portion 710 expands and presses the moving member 730. Accordingly, the moving member 730 presses the elastic member 750 and the neck 731 of the moving member 730 is moved, so the oil in the oil passage 500 is supplied to the oil filter 600. In ordinary times, the system is set such that the oil in the oil passage 500 can be supplied to the oil cooler 300 by the bypass valve 700, so the oil in the oil passage 500 is supplied to the oil filter 600 only at a temperature set for the wax portion 710.

The wax portion 710 of the bypass valve 700 has a plurality of wax members having different reference temperatures, so a plurality of reference temperatures can be set for the oil. That is, the bypass valve 700 may be a multistage bypass valve 700 having a plurality of reference values. The configuration of the bypass valve 700 is not limited thereto and may be changed in accordance with the design or environment.

Accordingly, the states of oil are discriminated on the basis of a first reference value and a second reference value for the temperature of the oil. It is determined that the engine 100 is at a low temperature when it is less than the first reference value (around 80° C.), it is determined that the engine 100 is at a room temperature when the oil temperature is the first reference value or more and less than the second reference value (around 120° C.), and it is determined that the engine 100 is at a high temperature when it is the second reference value or more, thereby controlling the oil such that the oil flows along different paths.

First, when the oil temperature is less than the first reference value (around 80° C.), oil is supplied to the engine 100 and bearings through the oil pump 200, the oil passage 500, the oil cooler 300, and the oil filter 600, and then exchanges heat with cooling water higher in temperature than the oil, so the oil is warmed up at the initial start of the engine (at a low temperature). That is, in this case, the oil increases in temperature through the oil cooler 300.

When the oil temperature is the first reference value (around 30° C.) or more and less than the second reference value (around 120° C.), oil is supplied to the engine 100 and the bearings through the oil pump 200, the oil passage 500, and the oil filter 600, so the oil does not pass through the oil cooler 300, and accordingly, a different pressure by the oil cooler 300 is reduced.

Further, when the oil temperature is the second reference value or more (around 120° C.), oil is supplied to the engine 100 and the hearings through the oil pump 200, the oil passage 500, the oil cooler 300, and the oil filter 600. That is, the oil at a high temperature is cooled through the oil cooler 300. Accordingly, when the oil temperature is the first reference value or more (around 80° C.) and less than the second reference value (around 120° C.), the oil is supplied to the engine 100 directly through the oil filter 600, not through the oil cooler 300, so pressure drop of the oil can be reduced and the fuel efficiency is improved accordingly. Obviously, the reference temperatures can be freely changed in accordance with the kinds of vehicles, environments, and designs.

Therefore, the engine oil supply system of the present invention provides the following effects.

First, oil in an oil pan is supplied upward to an oil passage by an oil pump. Accordingly, it is possible to achieve a layout for a multistage bypass valve using the length of the oil pan, so the layout can be achieved without changing engine layouts of the related art. Further, there is no need for a complicated oil supply circuit for an engine (cylinder block), so the structure is simple, machining is easy, and productivity is improved.

Second, an oil pan, an oil passage, a bypass valve, and an oil filter are integrated in a module. Accordingly, there is no need for an oil filter housing by using the oil pan as an oil filter housing, so the manufacturing cost and weight can be reduced. Further, since the bypass valve is disposed in the oil pan, it is not required to increase the shape of an oil filter housing.

Third, the engine oil supply system is disposed lower than the main gallery of an engine (cylinder block). Accordingly, oil remains in the part related to lubrication even if an engine is stopped, and the movement path of the oil is short, so it takes short time to obtain initial hydraulic pressure when starting an engine, and accordingly, durability of the engine is increased. Further, since the parts related to lubrication are concentrated close to the oil pan, the length of an oil supply circuit decreases, so pressure drop of oil decreases and fuel efficiency is improved. Further, the structure is simplified, so an oil supply structure that is optimized in terms of weight and manufacturing cost can be achieved.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine oil supply system comprising:

an oil pan connected with an oil pump at a first side and connected with an oil cooler at a second side;

an oil passage through which oil pressurized by the oil pump flows;

an oil filter disposed in the oil pan to filter impurities in the oil supplied from the oil pump; and a bypass valve disposed in the oil passage to selectively supply the oil in the oil passage to at least one of the oil cooler and the oil filter, wherein the bypass valve includes a wax portion configured to expand at a reference temperature, a moving member with a neck, and an elastic member, and wherein the wax portion of the bypass valve includes a plurality of wax members having different reference temperatures, for a plurality of reference temperatures to be set for the oil.

2. The engine oil supply system of claim 1, wherein the oil passage, the bypass valve, and the oil filter are integrated in a module in the oil pan.

3. The engine oil supply system of claim 1, wherein in the oil pan, the oil passage, the oil filter, and the oil pump are disposed adjacent a side from a longitudinal center line of the oil pan to provide a space for keeping oil in the oil pan.

4. The engine oil supply system of claim 1, wherein the oil cooler is a separate part and disposed between the oil pan and an engine.

5. The engine oil supply system of claim 1, wherein an oil channel is formed in the oil cooler to supply the oil passing through the oil cooler to the oil filter.

6. The engine oil supply system of claim 1, wherein the oil passage is formed in a longitudinal direction of the oil pan.

7. The engine oil supply system of claim 1, wherein:

the oil passage includes an intake hole at a first side into which the pressurized oil flows from the oil pump, a first supply hole for supplying oil to the oil cooler and a second supply hole for supplying oil to the oil filter at a second side; and the first supply hole and the second supply hole are formed at different positions to be alternately opened and closed by the bypass valve.

8. The engine oil supply system of claim 1, wherein the oil filter is integrated with the oil pan in a module, thereby eliminating a need for a housing for the oil filter.

9. The engine oil supply system of claim 1, wherein when oil temperature reaches a reference temperature, wax in the wax portion expands and presses against the moving member and the moving member presses against the elastic member, to move the neck of the moving member and to supply the oil in the oil passage to the oil filter.

10. The engine oil supply system of claim 1, wherein the bypass valve comprises a multistage bypass valve having a plurality of reference values.

11. The engine oil supply system of claim 1, wherein when a temperature of the oil is less than a first reference value, oil is supplied to an engine and bearings through the oil pump, the oil passage, the oil cooler, and the oil filter.

12. The engine oil supply system of claim 1, wherein when oil temperature is greater than or equal to a first reference value and less than a second reference value, oil is supplied to an engine and bearings through the oil pump, the oil passage, and the oil filter.

13. The engine oil supply system of claim 12, wherein when the oil temperature is greater than or equal to the second reference value, oil is supplied to the engine and the bearings through the oil pump, the oil passage, the oil cooler, and the oil filter.

* * * * *